US010335011B2

(12) United States Patent
Heppner

(10) Patent No.: US 10,335,011 B2
(45) Date of Patent: Jul. 2, 2019

(54) CLEANING DEVICE HAVING AN INDIVIDUALLY SWITCHABLE RINSING NOZZLE SYSTEM

(71) Applicant: MEIKO Maschinenbau GmbH & Co. KG, Offenburg (DE)

(72) Inventor: Jürgen Heppner, Schutterwald (DE)

(73) Assignee: MEIKO MASCHINENBAU GMBH & CO. KG, Offenburg (DE)

( * ) Notice: Subject to any disclaimer, the term of this patent is extended or adjusted under 35 U.S.C. 154(b) by 1012 days.

(21) Appl. No.: 14/576,622

(22) Filed: Dec. 19, 2014

(65) Prior Publication Data

US 2015/0101639 A1 Apr. 16, 2015

Related U.S. Application Data

(63) Continuation of application No. PCT/EP2013/063504, filed on Jun. 27, 2013.

(30) Foreign Application Priority Data

Jul. 2, 2012 (DE) ..... 10 2012 211 442

(51) Int. Cl.
*A47L 15/24* (2006.01)
*A47L 15/00* (2006.01)
*A47L 15/42* (2006.01)

(52) U.S. Cl.
CPC ..... *A47L 15/24* (2013.01); *A47L 15/0005* (2013.01); *A47L 15/0026* (2013.01);
(Continued)

(58) Field of Classification Search
None
See application file for complete search history.

(56) References Cited

U.S. PATENT DOCUMENTS

2005/0011544 A1* 1/2005 Rosenbauer ..... A47L 15/14 134/57 D
2005/0039777 A1* 2/2005 Jerg ..... A47L 15/16 134/18

(Continued)

FOREIGN PATENT DOCUMENTS

AT 254453 B 5/1967
CA 2537541 A1 * 2/2006

(Continued)

OTHER PUBLICATIONS

Translation of DE102009032964.*
English Translation of the International Preliminary Report on Patentability, PCT/EP2013/063504, dated Jan. 15, 2015.

*Primary Examiner* — Michael E Barr
*Assistant Examiner* — Jason P Riggleman
(74) *Attorney, Agent, or Firm* — Bose McKinney & Evans LLP

(57) ABSTRACT

Disclosed is a cleaning device for cleaning washware. The cleaning device may be a conveyor dishwasher. The cleaning device has at least one cleaning chamber and at least one transportation device. The transportation device transports the washware through the cleaning chamber in a transportation direction. The cleaning device has at least one final-rinse nozzle system for applying at least one final-rinse fluid, in particular fresh water, to the washware. The final-rinse nozzle system has at least two final-rinse nozzle units which are arranged in different positions transverse to the transportation direction. The final-rinse nozzle units can be switched independently of one another in order to apply the final-rinse fluid to the washware in the different positions independently of one another.

27 Claims, 3 Drawing Sheets

(52) U.S. Cl.
CPC ..... *A47L 15/0047* (2013.01); *A47L 15/4282* (2013.01); *A47L 15/241* (2013.01); *A47L 15/4214* (2013.01); *A47L 2401/04* (2013.01); *A47L 2401/30* (2013.01); *A47L 2501/01* (2013.01); *A47L 2501/20* (2013.01)

(56) References Cited

U.S. PATENT DOCUMENTS

| | | | |
|---|---|---|---|
| 2009/0120465 | A1 | 5/2009 | Peukert et al. |
| 2009/0151750 | A1 | 6/2009 | Ecker et al. |
| 2011/0023910 | A1 | 2/2011 | Dirschus |
| 2011/0139186 | A1 | 6/2011 | Disch et al. |
| 2014/0096798 | A1 | 4/2014 | Gaus et al. |

FOREIGN PATENT DOCUMENTS

| | | | | |
|---|---|---|---|---|
| DE | 1 963 534 | U | | 7/1967 |
| DE | 1 968 268 | U | | 9/1967 |
| DE | 10 2004 046 758 | A1 | | 4/2006 |
| DE | 10 2007 053 381 | B3 | | 4/2009 |
| DE | 10 2008 037 344 | A1 | | 2/2010 |
| DE | 10 2009 035 668 | A1 | | 2/2011 |
| DE | 102009032964 | | * | 3/2011 |
| DE | 10 2011 077 660 | A1 | | 12/2012 |
| EP | 1 704 809 | A2 | | 9/2006 |

* cited by examiner

CLEANING DEVICE HAVING AN INDIVIDUALLY SWITCHABLE RINSING NOZZLE SYSTEM

RELATED APPLICATIONS

This application is a continuation of PCT/EP2013/063504, filed Jun. 27, 2013, which claims priority to DE 10 2012 211 442.4, filed Jul. 2, 2012, both of which are hereby incorporated herein by reference in their entireties.

BACKGROUND

The invention relates to a cleaning device and to a method for washware. This cleaning device may be, in particular, a conveyor dishwasher, in particular for commercial use, for example in facilities for mass catering, such as, in particular, office canteens, canteens in schools, public authorities, hospitals or care facilities. The cleaning device and the method can be used, in particular, to clean washware in the form of items to be washed in a dishwasher which are used directly or indirectly for preparing, storing or serving food and drinks. Said items to be washed in a dishwasher may be, in particular, dishes and/or trays. Other fields of use of the present disclosure are also feasible in principle.

The prior art discloses a large number of cleaning devices. In this respect, reference is made in the text which follows, in particular, to dishwashers, without limiting further possible refinements of this disclosure. In addition to single-chamber dishwashers, so-called conveyor dishwashers in which the washware is transported through one or more cleaning chambers by means of a transportation device are also known. Conveyor dishwashers of this kind have, for example, different treatment zones or cleaning zones for the washware. Therefore, at least one wash zone for main cleaning of the washware and also at least one downstream final-rinse zone are present in many cases. At least one fresh-water final-rinse system (FWFRS) is generally provided in the final-rinse zone. In the fresh-water final-rinse system, fresh water, which can optionally be heated and/or admixed with a final-rinse aid, in particular in the form of so-called final-rinse solution, is applied to the washware by means of at least one nozzle. The fresh-water final-rinse system is generally used to rinse off the final residues of dirt and residues of wash liquid from the washware, in order to achieve a satisfactory dishwashing result.

A plurality of nozzles are generally used in the fresh-water final-rinse zone in order to apply the final-rinse solution to the washware. These nozzles are usually inserted into at least one pipe which is arranged in the fresh-water final-rinse zone transverse, for example orthogonal, to the transportation direction.

Depending, for example, on a passage width of the conveyor dishwasher, a specific number of nozzles is generally required in order to generate a desired spray pattern. This spray pattern should be enough to wet the washware over the entire passage width in as uniform a manner as possible. If too few nozzles are used, gaps in the film of the cleaning fluid on the washware may result for example. In addition, a nozzle generally requires a minimum quantity of final-rinse fluid per unit time in order to form a good spray pattern. Falling below this quantity generally leads to a poor spray pattern with the washware consequently being wetted in a non-uniform manner.

Conveyor dishwashers are described, for example, in DE 10 2004 046 758 A1, DE 10 2007 053 381 B3, DE 10 2009 035 668 A1 or in the German patent application bearing the number DE 10 2011 077 660 which was published after this application. A large number of conveyor dishwashers have two rinsing pipes in the final-rinse zone, wherein one of these rinsing pipes is arranged above the transportation device and one is arranged below the transportation device. These rinsing pipes can each have, for example, six uniformly distributed nozzles, so that the washware is rinsed off from above and from below. The rinsing-off effect is generally uniform over the entire passage width, that is to say the maximum loadable width of the transportation device perpendicular to the transportation direction. For example, conventional conveyor dishwashers can have a width of 500 mm, 750 mm, 1000 mm or even 1200 mm. Depending on the passage width, the rinsing pipes of the fresh-water final-rinse zone, also called nozzle pipes, can be designed to be longer or shorter for example, and the number of nozzles in these nozzle pipes can be selected in accordance with this.

The number of nozzles, the size of the nozzles (for example the opening cross section of said nozzles) and/or a pressure in the fresh-water final-rinse system can have a strong influence on the throughput of final-rinse fluid and therefore the consumption, for example, of fresh water. However, the total consumption of fresh water has a significant influence on the consumption of resources by the conveyor dishwasher. Fresh water generally has to be heated, for example to an operating temperature of between 80° C. and 100° C., for example to from 85° C.-90° C. Furthermore, final-rinse aid and/or cleaning agent generally have/has to be added in a metered fashion to the final-rinse fluid depending on the quantity of fresh water flowing in.

However, phases and/or periods of time in which a small amount of washware is produced repeatedly occur during operation of the conveyor dishwasher. In these phases, there may be areas on the transportation device, for example on a conveyor belt, in which there is no washware. As an alternative, for example in the case of a rack conveyor dishwasher in which racks holding the washware are transported through the conveyor dishwasher, these racks may be only partially loaded with washware, or the transportation device may be only incompletely populated by conveyor racks.

The prior art discloses, in principle, devices with the aid of which it is possible to identify whether there is washware in the transportation device or not. Depending on how the transportation device is populated by washware, individual cleaning zones of the dishwasher can then be switched on and switched off in accordance with the progress of the washware. The operation of the fresh-water final-rinse zone can also be influenced in such a way. Fresh water can be saved in this way.

AT 254453 discloses a dishwasher which has a conveyor belt for conveying dishes through a wash zone and a rinse zone. Dishes are detected by means of a photocell control means and switching on and switching off of rinse water is controlled.

DE 1 968 268 discloses a dishwasher with regulation of dishwashing water, in which dishes are routed past a washing and rinsing device by means of a conveyor belt. A pivotable grid is provided upstream of a dishwashing zone in a movement region of the dishes for switching on and switching off dishwashing water. The grid which is moved by the dishes immediately switches on the dishwashing water in the event of a forward movement and switches off the dishwashing water in the event of reversal.

DE 1 963 534 U discloses a rinsing device for dishwashers with continuous or intermittent transportation of dishes. Said rinsing device has a momentary-contact switch which is mounted such that it swings. As dishes pass through, an electrical circuit to a magnetic valve is closed and passage of water is enabled for as long as dishes which are passing through hold the momentary-contact switch in an inclined position.

In spite of the advantages achieved by the known devices, in particular in respect of saving resources, further potential for optimization exists, in particular in the case of commercial dishwashers. In this case, it should be noted, in particular, that when the transportation device is not completely populated with washware as before, final-rinse fluid is unnecessarily sprinkled into empty belt regions and, as a result, fresh water in particular is consumed.

SUMMARY

This disclosure provides a cleaning device and a method for cleaning washware, which cleaning device and method at least largely avoid the disadvantages of known devices and methods. Embodiments in accordance with these teachings further reduce the consumption of fresh water, and amounts of heating energy which are expended for a final-rinse zone and also consumption of final-rinse aid and/or detergent additives are further intended to be reduced.

In this case, the proposed method can be carried out using a cleaning device according to this disclosure. As an alternative or in addition, the cleaning device can also be designed to carry out a method according to this disclosure. Accordingly, reference can be made to the description of the cleaning device for possible refinements of the method, and vice versa. However, other refinements are also possible in principle.

It should be noted in this context that the expressions "have," "include" and "comprise" may be understood as being both exhaustive and non-exhaustive in the text which follows. Accordingly, the expression "A comprises B," for example, may be understood to mean that A does not have any further elements apart from B (exhaustive meaning). As an alternative, the expression may also mean that A comprises one or more further elements, for example element C, in addition to B.

Further, it should be understood that various structural terms used throughout this disclosure and claims should not receive a singular interpretation unless it is made explicit herein. By way of non-limiting example, the terms "cleaning chamber," "transportation device," "nozzle," to name just a few, should be interpreted when appearing in this disclosure and claims to mean one or more. All other terms used herein should be similarly interpreted unless it is made explicit that a singular interpretation is intended.

A cleaning device for cleaning washware is proposed in a first aspect of this disclosure. In this context, a cleaning device within the scope of this disclosure is generally to be understood to mean a device in which the washware is cleaned by means of at least one cleaning fluid in order to free said washware at least partially from adhering dirt or other impurities. In addition, the cleaning device can also have a germ-killing effect or even a disinfectant effect on the washware. Accordingly, a method for cleaning washware, also called cleaning method in the text which follows, will be understood to mean the application of at least one cleaning fluid to the washware for the purpose of at least partially removing adhering dirt from the washware. In addition, the cleaning method can have a germ-killing effect or even a disinfectant effect on the washware.

In this context, washware can generally be understood to mean any items which are subject to cleaning or to a cleaning method. In this context, reference is made, without restriction of further possible refinements, in the text which follows to washware in the form of items to be washed in a dishwasher. In this context, items to be washed in a dishwasher are intended to comprise any articles which are intended to be used for preparing, serving or storing food and drinks. Examples of these include dishes such as cups, plates, glasses, bowls or pans. Pots, trays, cutlery, keep-warm devices or similar devices are further included.

The cleaning device can be designed, in particular, as a conveyor dishwasher. In this context, a conveyor dishwasher is intended to be understood to mean a dishwasher, that is to say a machine for cleaning items to be washed in a dishwasher in the form of dishes, which is designed to transport the items to be washed in a dishwasher through a cleaning chamber. Said dishwasher may be, in particular, a belt-conveyor dishwasher and/or a rack-conveyor dishwasher, that is to say a dishwasher in which the dishes are transported through the cleaning device by means of a conveyor belt, for example a conveyor belt on which the dishes are placed directly and/or on which one or more racks holding the dishes to be cleaned are placed. The conveyor dishwasher can be designed, in particular, for commercial use, for example in one or more of the abovementioned facilities for mass catering.

The cleaning device comprises at least one cleaning chamber and at least one transportation device which is designed to transport the washware through the cleaning chamber in a transportation direction. In this context, a cleaning chamber is generally intended to be understood to mean a chamber in which the above-described cleaning process for the washware is completely or partially carried out. In particular, the cleaning fluid or one of several cleaning fluids can be applied in a cleaning chamber. The chamber is preferably fully or partially enclosed by a housing. In particular, the cleaning chamber can be of tunnel-like design or comprise a portion of a tunnel, for example with an inlet and an outlet, wherein the washware is introduced into the cleaning chamber at the inlet and is discharged from the cleaning chamber at the outlet.

Within the context of this disclosure, a transportation device is generally intended to be understood to mean any device which is designed to transport the washware through the cleaning chamber in the transportation direction. For example, this transportation device can be selected from the group comprising a belt-conveyor device with at least one conveyor belt, and a roller conveyor device with at least one conveyor roller or a plurality of conveyor rollers, for example one or more driven conveyor rollers, by means of which, for example, the washware directly and/or one or more racks holding the washware can be transported through the cleaning chamber in the transportation direction.

The cleaning device further has at least one final-rinse nozzle system for applying at least one final-rinse fluid to the washware. As stated above, the cleaning process is performed using at least one cleaning fluid. The final-rinse fluid is therefore one example of a cleaning fluid. In addition to the final-rinse fluid, further cleaning fluids can be used in the cleaning device in order to wash the washware and rinse off coarse residues of dirt from the washware, for example before the final-rinse fluid is applied. Finally, the final-rinse fluid serves to rinse off adhering residues of previously used cleaning fluids which were previously applied to the washware, so that residues of cleaning fluids preferably no longer remain on the washware. The final-rinse fluid is therefore preferably the last cleaning fluid in a chain of several cleaning fluids which are applied to the washware, with which last cleaning fluid the washware is rinsed off, preferably so as to leave no residues. To this end, the final-rinse fluid may be, for example, an aqueous final-rinse fluid to which one or more final-rinse aids are preferably added. In this context, a final-rinse aid is generally intended to be understood to mean a liquid which improves the drying of the washware. The final-rinse aid can comprise, for example, one or more surfactants, for example non-ionic surfactants which reduce the surface tension of the final-rinse fluid, for example the surface tension of the water, so that, for example, the final-rinse fluid can flow off without droplets being formed. As an alternative or in addition, the final-rinse aid can comprise, for example, further substances, for example one or more organic acids such as, for example, citric acid and/or lactic acid, for example for complexing with hardness-forming ions such as calcium ions or magnesium ions. These one or more acids can also serve to neutralize alkaline constituents. Furthermore, one or more solvents, preservatives, solubilizers and also possibly one or more fragrances can be contained in the final-rinse aid. The final-rinse fluid can therefore be, in particular, an aqueous solution of a final-rinse aid, wherein the final-rinse aid can comprise one or more of the abovementioned constituents, in particular one or more non-ionic surfactants and/or one or more organic acids. However, as an alternative or in addition, the final-rinse fluid can also simply be fresh water or comprise fresh water. In particular, the temperature of the final-rinse fluid can be controlled and said final-rinse fluid can have a temperature of from 80° C.-100° C., preferably of from 85° C.-95° C. This temperature control may, for example, promote the above-described drying effect without residues, preferably without droplets being formed on the washware.

Within the scope of this disclosure, a nozzle system is generally intended to be understood to mean a device which has one or more nozzles. A nozzle is generally intended to be understood to mean a device at which a fluid can be provided, for example by means of a line system and/or pipe system, so that said fluid can be discharged through one or more openings in the nozzle. A nozzle itself can comprise one or more openings for example. The provided fluid can, for example, be discharged through these one or more openings under pressure, so that a sprinkling process and/or a spray process takes place, in which process/processes the fluid, for example the cleaning fluid and in this case, in particular, the final-rinse fluid, is sprinkled and/or sprayed onto the washware. A final-rinse nozzle system is therefore intended to be understood within the meaning of the above definition to mean a nozzle system through which final-rinse fluid can be dropped, sprinkled or sprayed onto the washware.

The final-rinse nozzle system has at least two final-rinse nozzle units which are arranged in different positions transverse to the transportation direction. The transportation direction therefore defines a direction in space, at least locally at the site of the final-rinse nozzle system. The final-rinse nozzle system defines at least one further direction in space transverse to said direction in space of the transportation direction. In this context, "transverse" is intended to be understood to mean a direction in space which does not run parallel to the transportation direction. Said direction in space may preferably be a direction in space perpendicular to the transportation direction at the site of the final-rinse nozzle system, that is to say a direction in space which runs at 90° to the transportation direction. However, deviations from an exact orthogonality can also occur in this case, preferably deviations through no more than 45°, for example through no more than 30°, for example through no more than 20°, and particularly preferably through no more than 10° or even no more than 5°.

The final-rinse nozzle system therefore has at least two final-rinse nozzle units. In this context, a nozzle unit is intended to be understood to mean a unit of the nozzle system which comprises at least one nozzle, that is to say an element having at least one opening through which the cleaning fluid, in this case the final-rinse fluid in particular, can be discharged, that is to say can be dropped, sprinkled or sprayed. The final-rinse nozzle system therefore has two, three, four, five, six or more final-rinse nozzle units of this kind which are arranged transverse to the transportation direction, so that said final-rinse nozzle units are arranged in the at least two different positions transverse to the transportation direction. Therefore, at least two final-rinse nozzle units are arranged next to one another as seen in the direction of the transportation direction. Therefore, the transportation device can have, for example, a transportation width, that is to say a maximum width which can be populated by the washware. This transportation width can also be called the passage width. The final-rinse nozzle system is preferably designed in such a way that the final-rinse nozzle units cover the entire transportation width of the transportation device. This means that the different positions transverse to the transportation direction and/or the number of final-rinse nozzle units are selected in such a way that washware which is positioned on the transportation device in any desired manner is in each case detected by the final-rinse fluid which is discharged from the final-rinse nozzle units, for example independently of whether the washware is now arranged in the center or at the edge of the transportation device, for example in the center or at the edge of the conveyor belt. The final-rinse nozzle units can form, for example, a chain of nozzle units which are arranged transverse to the transportation direction and which preferably can spray or sprinkle fluid over the entire width of the transportation device, for example the entire width of the conveyor belt.

In this context, the final-rinse nozzle units can be switched independently of one another in order to apply the final-rinse fluid to the washware in the different positions independently of one another. In this context, "to switch" is generally intended to be understood within the scope of this disclosure in connection with a nozzle unit to mean driving of the discharge of a fluid from the nozzle unit. A "nozzle unit" is therefore intended to be understood to mean a unit of one or more nozzles which can be jointly controlled in this way. By way of example, the switching process can be a digital switching process in which it is possible to switch between a state in which fluid is discharged from the nozzle unit (switched-on state) and a switched-off state in which no fluid is discharged from the nozzle unit. As an alternative to a purely digital state (which can be realized, for example, by means of an open/close switching element), the switching process can also comprise one or more intermediate states and/or intermediate switching states or a continuous switching process, wherein one or more intermediate states can be provided between the above-described states of the switched-on state and the switched-off state, in which intermediate states fluid is discharged from the nozzle unit at a volumetric flow rate and/or mass flow rate which is reduced in comparison to the switched-on state.

Numerous different technical options which are known to a person skilled in the art in principle are feasible for carrying out the above-described switching process. For example, one or more switching elements can be provided in order to carry out the switching process. For example, one or more switching elements can be provided for switching the final-rinse nozzle units, in particular switching elements selected from the group comprising: a valve; a slide; and a tap. The at least one switching element can, in particular, be designed in order to interrupt or enable at least supply of final-rinse fluid to the final-rinse nozzle units. As an alternative or in addition, the ability to switch can also be performed, for example, by a plurality of separate pump systems, so that it is possible, for example, for the switching process to involve application of pressure to the respective final-rinse nozzle unit or no application of pressure. Other technical implementations are also feasible in principle and known to a person skilled in the art in principle.

In this context, "can be switched independently of one another" is generally intended to be understood within the scope of this disclosure to mean that the at least two nozzle units can be switched in such a way that one nozzle unit can be switched independently of the switching of another nozzle unit. Therefore, it is preferably possible to select at least one switching state for any final-rinse nozzle unit, irrespective of the switching state of one or more other final-rinse nozzle units. Therefore, the final-rinse nozzle units can, in particular, be selectively switched, in particular the individual final-rinse nozzle units of a fresh-water final-rinse system can be selectively switched. In this way, it is possible for the cleaning fluid to be applied to the washware transverse to the transportation direction in the at least two above-described different positions independently of one another. In this connection, "independent application with final-rinse fluid" is intended to be understood to mean that, in at least a first of the different positions, discharge or non-discharge of final-rinse fluid from a final-rinse nozzle unit which is arranged there can be switched in order to apply final-rinse fluid to the washware irrespective of whether final-rinse fluid is likewise discharged in at least one second position of the different positions from the nozzle unit located there.

As stated above, the cleaning device can be selected, in particular, from the group comprising a belt-conveyor dishwasher and a rack-conveyor dishwasher. Accordingly, the transportation device can comprise, in particular, at least one conveyor belt and/or one or more conveyor rollers. The transportation device can be populated with several items of washware next to one another, in particular transverse to the transportation direction. For example, the transportation device can have a transportation width of at least 300 mm transverse to the transportation direction, for example perpendicular to the transportation direction. By way of example, transportation widths of 500 mm or more, 750 mm or more, 1000 mm or more or even 1200 mm or more can be provided. The transportation width can be prespecified, for example, by a corresponding width of a conveyor belt and/or of a roller system of the transportation device which can be populated by the washware to the maximum extent.

The final-rinse nozzle system can have, in particular, at least three final-rinse nozzle units which are arranged next to one another transverse to the transportation direction. In particular, at least four, particularly preferably at least six, final-rinse nozzle units can be provided. Each final-rinse nozzle unit can have, for its part, one or more nozzles, for example one or more discharge openings for the final-rinse fluid. The final-rinse nozzle units can be arranged, for example, in at least one nozzle arm which is arranged transverse to the transportation direction. In this context, a nozzle arm is intended to be understood to mean, for example, a rigidly installed or else pivotable arm which mechanically holds the final-rinse nozzle units and preferably also supplies the final-rinse fluid. However, as an alternative or in addition to arrangement in a nozzle arm, the final-rinse nozzle units can also be arranged, for example, in a top part and/or bottom part of the cleaning chamber and/or in the cleaning device in some other way. As will be explained in greater detail below, the final-rinse nozzle units can have, for example, at least one first group of final-rinse nozzle units above the washware and at least one second group of final-rinse nozzle units below the washware, for example a nozzle arm which is arranged above the transportation device and applies the final-rinse fluid to the washware from above, and at least one nozzle arm which is arranged below the washware and applies the final-rinse fluid to the washware from below.

Further optional refinements relate to the ability to switch the nozzle units independently. This can be ensured, for example, by an associated valve being connected upstream of each final-rinse nozzle unit, wherein the associated valve can be switched in order to switch the application of final-rinse fluid to the washware by means of the final-rinse nozzle unit. As described above, this switching can be, for example, digital switching between a switched-on state and a switched-off state or else switching which allows one or more intermediate positions, in steps or else continuously. As stated above, as an alternative or in addition to switching by means of at least one valve, other refinements are also feasible, for example refinements by means of independent application of pressure so that pressurized cleaning fluid can be applied to the respective final-rinse nozzle unit, for example in order to switch on a final-rinse nozzle unit, for example by means of a corresponding pump, wherein the application of pressure is removed in order to switch off said final-rinse nozzle unit for example.

If, in general, one or more switching elements are used in order to ensure the ability to independently switch the at least two final-rinse nozzle units, said switching elements can be designed in different ways. For example, the at least one switching element can be selected from the group comprising: a valve, in particular a magnetic valve and/or a solenoid valve and/or a valve having at least one piezo actuator; a slide, in particular a slide which can be mechanically operated; and a tap. However, other refinements are also possible in principle. In particular, the at least one switching element can be switched electrically, so that said switching element can be switched, for example, by a control means of the cleaning device. However, as an alternative or in addition, switching elements which can be operated mechanically, pneumatically or hydraulically can be used, for example in order to allow the at least two final-rinse nozzle units to be switched independently.

Final-rinse fluid can be applied to the final-rinse nozzle units in particular in each case by means of at least one final-rinse fluid supply. In this context, the final-rinse nozzle units can be fed, for example, by means of a common final-rinse fluid supply, in particular by means of a common fresh-water supply. However, as an alternative or in addition, the final-rinse nozzle units can also have independent final-rinse fluid supplies. When a common final-rinse fluid supply is provided, the final-rinse nozzle units can be connected, for example, to the common final-rinse fluid supply via final-rinse lines, wherein in each case at least one associated switching element can be arranged in each final-rinse line for example. For example, the common final-rinse fluid supply can comprise a common final-rinse fluid tank and/or a common treatment device for final-rinse fluid. As an alternative or in addition, the common final-rinse fluid supply can also comprise a common fresh-water supply, for example a common fresh-water tap and/or a common, for example on-site, fresh-water connection by means of which fresh water can be supplied to all of the final-rinse nozzle units. By way of example, the cleaning device can comprise a central connection for fresh water, which central connection can be connected to a common on-site fresh-water supply, wherein the common connection then splits and leads directly or indirectly to the individual final-rinse nozzle units, for example via final-rinse lines. In this context, it is possible, for example, for one or more switching elements and/or one or more treatment devices to be interposed. These elements can be arranged, for example, in the individual final-rinse lines and/or upstream of a branch point of the individual final-rinse lines.

The final-rinse fluid supply to the final-rinse nozzle units can be equipped, in particular, with at least one additional regulation element. This at least one optional regulation element can be designed, in particular, to keep a hydraulic pressure in the final-rinse system constant. This regulation element can have the effect that a constant pressure is always present at the final-rinse nozzle units even if, according to this disclosure, individual or several final-rinse nozzle units are switched off. In this context, "constant" is preferably intended to be understood to mean an absolute constancy, but it also being possible in principle to tolerate deviations and/or fluctuations preferably of no more than 50% of an average pressure, in particular of no more than 20% of the average pressure, and particularly preferably of no more than 10%. The optional at least one regulation element provides the advantage that pressure fluctuations which occur when the final-rinse nozzle units are switched can be at least largely avoided. In particular, without a regulation element, the pressure in the system may increase under unfavorable conditions and a relatively large quantity of final-rinse fluid may flow through the remaining switched-on final-rinse nozzle units. The optional at least one regulation element can therefore further assist the effect of this disclosure, specifically of saving final-rinse fluid.

The at least one optional regulation element can be arranged, for example, in one or more sections of a final-rinse fluid supply to the final-rinse nozzle units. In this context, a regulation element can be associated, for example, with each final-rinse nozzle unit, or a common regulation element may be provided for a group of final-rinse nozzle units.

The at least one optional regulation element can in turn comprise, for example, at least one valve, coupled for example to at least one sensor, in particular at least one flow sensor and/or at least one pressure sensor. By way of example, the at least one regulation element can comprise at least one needle valve, for example at least one needle valve which is operated by electric motor. A valve position can be adjusted or regulated, for example, by means of a signal of the sensor in such a way that a constant pressure prevails in the final-rinse fluid supply. By way of example, at least one regulator can be provided for this purpose.

As already indicated above, the cleaning device can further have at least one treatment device. In this context, a "treatment device" can be understood in general to mean a device which is designed to adjust at least one property of the final-rinse fluid before this final-rinse fluid is supplied to the final-rinse nozzle system. By way of example, this at least one property can be selected from the group comprising a temperature of the final-rinse fluid, a purity of the final-rinse fluid and a concentration of at least one component of the final-rinse fluid, for example of a final-rinse aid. The treatment device can accordingly be selected, for example, from the group comprising: a temperature-control device for adjusting a temperature of the final-rinse fluid, in particular a heating device, and particularly preferably a flow heater and/or a boiler; a treatment system for adjusting a purity of the final-rinse fluid, in particular a filter and/or an osmosis system (this also including the possibility of a reverse-osmosis system); a metering device for adjusting at least one concentration of one component of the final-rinse fluid, in particular of a final-rinse aid. As an alternative or in addition, other types of treatment devices are also feasible.

The cleaning device can further comprise at least one control means. In this context, a "control means" is generally understood to mean an electronic device which can control and/or regulate one or more operating sequences of the cleaning device. By way of example, the control means can be designed from a programming point of view to carry out at least one cleaning program and/or a plurality of cleaning programs in the cleaning device. To this end, the control means can actuate, for example, one or more elements of the cleaning device. The control means can particularly preferably be designed to switch the final-rinse nozzle units. By way of example, to this end, one or more electronic connections can be provided between the control means and the final-rinse nozzle units and/or one or more switching elements which ensure that the final-rinse nozzle units (for example valves and/or pumps) can be switched independently.

The control means can comprise, for example, at least one data-processing device, for example at least one computer or microcontroller. The control means can further comprise at least one interface, for example an electronic interface and/or a man-machine interface, for example an input/output device such as a display and/or a keypad. The control means can be constructed, for example, centrally or else in a decentralized manner. Therefore, a plurality of decentralized control means can also be provided for example, for example one control means for each switching element and/or one control means for each final-rinse nozzle unit and/or one control means for each washware sensor. Other refinements are also feasible.

The control means can be designed, in particular, to combine several final-rinse nozzle units into groups as required, wherein the final-rinse nozzle units in a respective group are switched together. Other refinements are also feasible. In this context, "as required" is intended to mean, as will be explained in greater detail below, that the control means identifies whether there is currently a need for application of final-rinse fluid in the region which is covered by the respective group of final-rinse nozzle units and to which final-rinse fluid is applied, that is to say whether there is washware in this region or not for example.

The cleaning device can further have at least one washware sensor. Within the scope of this disclosure, a "washware sensor" is generally intended to be understood to mean a device which can identify the presence of washware and/or a position of the washware. Identification can be performed, for example, using one or more of the following measurement principles: electrically, electromechanically, mechanically, inductively, by means of ultrasound, by means of infrared rays, optically, by means of at least one image recording means, for example a camera system. By way of example, the at least one washware sensor can have at least one detection region which can be, for example, one-dimensional or two-dimensional and which preferably covers the entire width of the transportation device. In this way, for example, the presence of the washware in this detection region can be identified in a one-dimensional or two-dimensional or possibly even a three-dimensional manner.

By way of example, the transportation device can be divided into sectors in a direction perpendicular to the transportation direction, wherein it is possible, for example by means of the at least one washware sensor, to identify whether a respective sector is populated with washware or not. The sectors can correspond, for example, to the above-described regions of the final-rinse nozzle units, so that it is possible, for example, to identify whether the respective at least one final-rinse nozzle unit, which is associated with a sector, should be switched on or not, for example by means of the identification of the washware, since there is washware, or respectively there is no washware, in this sector.

Therefore, in general, the washware sensor can be designed to identify the presence of the washware and/or a position of the washware, wherein the cleaning device can be designed to switch on or to switch off the final-rinse nozzle units in accordance with a requirement which is detected by means of the washware sensor. As already stated above, a "requirement" is intended to be understood to mean the presence of washware, for example in a sector of the transportation device which is associated with the final-rinse nozzle unit, wherein, for example, a requirement is determined when washware is present and the respective final-rinse nozzle unit is switched on, and wherein, for example, no requirement is determined when washware is absent and, for example, the respective final-rinse nozzle unit is switched off.

As stated above, the final-rinse nozzle system can have a plurality of application regions which are arranged next to one another transverse to the transportation direction. These application regions can be, for example, the above-described sectors of the transportation device. At least one final-rinse nozzle unit can be associated with each application region for example, wherein final-rinse fluid from the associated final-rinse nozzle unit can be applied to washware within the application region. The cleaning device can then be designed, in particular, to switch on the associated final-rinse nozzle unit of an application region when the washware sensor identifies that there is washware within the application region. The cleaning device can further be designed to switch off the respective final-rinse nozzle unit when the washware sensor identifies that there is no washware within the application region.

As stated above, the washware sensor can be based on different measurement principles and/or detection principles. The washware sensor can particularly preferably be selected, for example, from the group comprising: a mechanical or electromechanical momentary-contact switch, an optical sensor, a light barrier and an image-recording sensor, in particular a camera system. Other washware sensors can therefore also be used in principle. By way of example, the at least one washware sensor can be selected from the group comprising: an electrical washware sensor, for example a capacitive and/or inductive washware sensor; an electromechanical washware sensor, for example a washware sensor in the form of an electromechanical momentary-contact switch and/or electromechanical switch and/or in the form of an electromechanical lever; a mechanical washware sensor, in particular a mechanical switch and/or a mechanical momentary-contact switch; an inductive washware sensor; an ultrasound washware sensor; an optical washware sensor, in particular a washware sensor which is based on infrared rays and/or which is based on ultraviolet rays and/or which is based on visible light, for example at least one light barrier and/or at least one optical reflection sensor; and an image-recording sensor, for example a camera system. The washware sensor can have, for example, a detection region, wherein punctiform, one-dimensional, two-dimensional or else three-dimensional detection regions are feasible. A two-dimensional detection region can be implemented, for example, by means of a camera system. A punctiform detection region can be implemented, for example, by means of an electromechanical momentary-contact switch.

The cleaning device can have, in particular, a plurality of washware sensors. By way of example, as described above, a plurality of application regions can be provided, wherein at least one washware sensor can be associated with each application region. As an alternative or in addition, a respective washware sensor can be associated with a respective final-rinse nozzle unit or a respective group of final-rinse nozzle units. Other refinements are also possible in principle.

The cleaning device can comprise, in particular, a plurality of cleaning zones. The transportation device can be designed, for example, to move the washware in succession through the cleaning zones. A cleaning fluid can be applied to the washware in each cleaning zone. By way of example, the cleaning fluids of the different cleaning zones can be different from one another. The cleaning zones can comprise at least one final-rinse zone, wherein the final-rinse nozzle system can be arranged in the final-rinse zone. The final-rinse zone can comprise, for example, a fresh-water final-rinse zone. As an alternative or in addition, the final-rinse zone can also comprise at least one pump final-rinse zone.

The cleaning device can comprise, in particular, at least one cleaning zone which is arranged upstream of the final-rinse zone, in particular the fresh-water final-rinse zone, in the transportation direction, wherein the upstream cleaning zone can be selected, for example, from the group comprising: a pre-clearing zone, a wash zone, and a pump final-rinse zone.

The cleaning device can have, in particular, at least one tank for supplying cleaning fluid to a nozzle system of the upstream cleaning zone. The cleaning device can be designed, in particular, to supply final-rinse fluid, in particular fresh water, from the final-rinse nozzle units to the at least one tank after the final-rinse fluid, in particular the fresh water, has been applied to the washware. In particular, a plurality of tanks can be provided, wherein at least one of the tanks can have an overflow and/or another liquid-transfer device to a tank which is arranged upstream in the transportation direction. The upstream tank can feed, in particular, a nozzle system which is arranged upstream in the transportation direction. Therefore, the cleaning device can comprise, for example, a tank system having a plurality of tanks, wherein one or more overflows and/or other liquid-transfer devices can be provided between the tanks. In this way, for example, cleaning zones which are arranged upstream in the transportation direction can be supplied with cleaning fluid of a lower quality than in zones which are arranged downstream. The cleaning zone with the cleaning fluid of the highest quality can then be, in particular, the final-rinse zone.

One or more further zones can be arranged downstream of the final-rinse zone in the transportation direction. Therefore, for example, at least one drying zone can be arranged downstream of the final-rinse zone in the transportation direction. In the drying zone, the washware can, for example, dry on its own and/or an air stream can, for example, be applied to said washware in order to assist drying, for example by means of a fan, and particularly preferably by means of a hot-air fan.

A method for cleaning washware is proposed in a further aspect of this disclosure. The washware is transported through at least one cleaning chamber of a cleaning device by means of at least one transportation device. At least one final-rinse fluid is applied to the washware by means of at least one final-rinse nozzle system. The final-rinse nozzle system has at least two final-rinse nozzle units which are arranged in different positions transverse to the transportation direction. The final-rinse nozzle units are switched independently of one another in order to apply the final-rinse fluid to the washware in the different positions independently of one another. As stated above, the cleaning device can be, in particular, a cleaning device according to one or more of the above-described refinements or according to one or more of the refinements which are still to be described below.

In the method, it is possible, as stated above, in particular for at least one washware sensor to be used in order to identify the presence of the washware and/or a position of the washware. In particular, the final-rinse nozzle units can then be switched on or switched off in accordance with a requirement which is detected by means of the washware sensor.

The final-rinse nozzle system can have, in particular, a plurality of application regions which are arranged next to one another transverse to the transportation direction. At least one final-rinse nozzle unit can be associated with each application region, wherein final-rinse fluid from the associated final-rinse nozzle unit can be applied to washware within the application region. In particular, the method can be carried out in such a way that the associated final-rinse nozzle unit is switched on when the washware sensor identifies that there is washware within the application region. The respective final-rinse unit can further be switched off when the washware sensor identifies that there is no washware within the application region.

The proposed cleaning device and the proposed cleaning method have a large number of advantages over known cleaning devices and cleaning methods. In particular, there are particular advantages over conventional cleaning devices in which a final-rinse system, for example a fresh-water final-rinse system, is switched on or switched off over an entire region of a dishwasher. Systems of this kind have, as stated above, considerable disadvantages when only a portion of the transportation device, for example of the conveyor belt, is occupied over the passage width of the dishwasher. In this case, final-rinse fluid is unnecessarily sprinkled over empty regions of the transportation device, for example over empty regions of a belt, and as a result fresh water, in particular, is consumed. However, the proposed cleaning device can lead to minimal consumption of fresh water in the system of a fresh-water final-rinse system of a dishwasher in order to further reduce, for example, the required fresh water and the heating energy which is optionally expended for this purpose and also the consumption of optional final-rinse aid and/or detergent additives.

In particular, a final-rinse system, for example a fresh-water final-rinse system, can be implemented by means of this disclosure, said final-rinse system being designed in such a way that each final-rinse nozzle unit can be switched independently of other final-rinse nozzle units. In particular, a device can be associated with each final-rinse nozzle unit in order to switch on or switch off the flow through the respective nozzle unit. This may take place, for example, in connection with a system for identifying areas of the transportation device, for example areas of the belt, which are occupied by washware and respectively which are empty.

By way of example, similarly to a printer head in an inkjet printer, final-rinse fluid can be sprayed only where it is required. In unoccupied areas of the transportation device, for example in unoccupied areas of the belt, one or more nozzle units can be switched off in order to reduce the consumption of final-rinse fluid, in particular the consumption of fresh water. As an alternative or in addition, individual nozzles or nozzle units can also be combined to form one or more groups, wherein the nozzles or nozzle units of one group can be switched on and switched off together. Therefore, the entire passage width of the transportation device can, for example, be divided into two, three, four or more regions, and the occupation of said regions can be detected and evaluated and the associated nozzle groups in said regions can be switched. In this context, for example in the case of partial loading, the consumption of fresh water can be reduced to two thirds or to one third of the full quantity when said passage region is divided into three regions.

As stated above, the cleaning device can have, in particular, a system for identifying washware, in particular items to be washed in a dishwasher. The system can, as stated above, have one or more washware sensors. The system for identifying washware can, for example, be designed in such a way that it is able to identify occupation of the transportation device by washware, for example occupation of a belt, in several application areas, distributed over the passage width, and to switch on the corresponding nozzles in the occupied application regions either directly or by means of the control means which is present in the cleaning device, for example when the final-rinse zone is reached, and, respectively, to switch off the final-rinse nozzle units in the unoccupied regions.

The at least one washware sensor, preferably the plurality of washware sensors, for example for identifying occupied regions of a belt, can be designed in a simple and cost-effective manner. By way of example, said washware sensors can be implemented in the form of mechanical momentary-contact switches. Optical sensors, for example optical momentary-contact switches, for example in the form of reflection light barriers, image-forming sensors, such as camera systems for example, or other kinds of sensors for example are likewise conceivable. It is possible, for example, for an individual washware sensor to scan the entire passage width, for example the entire belt width, for occupation by washware, for example by a camera being used, with which, for example, switch-on and/or switch-off processes at individual final-rinse nozzle units can then be initiated. As an alternative, the washware sensor system can also have, for example, an individual washware sensor for each individual nozzle unit. As an alternative, all embodiments which lie between said extreme cases are possible. It is also possible to switch the individual nozzle units or groups of nozzle units in a simple manner. As stated above, one or more switching elements can be provided, it being possible to switch on or switch off individual nozzle units or groups of nozzle units by means of said switching elements. By way of example, one or more valves, taps or slides can be provided. Therefore, a simple switching process can be performed, for example, by means of a solenoid valve and/or by means of one or more piezo valves and/or a slide which can be mechanically operated. Other switching elements for allowing the final-rinse fluid to flow through to the nozzle units are likewise feasible.

The described method and the proposed cleaning device can be used in an efficient manner in different types of final-rinse nozzle systems. For example, the method according to this disclosure can be used in fresh-water final-rinse systems in which all of the fresh-water final-rinse nozzles are supplied with final-rinse fluid and/or fresh water together. As an alternative or in addition, fresh-water final-rinse systems which are supplied from several different sources can also be designed according to this disclosure. In this context, one or more different types of treatments of the supply can also be detected. For example, the supply can have a device for heating the final-rinse fluid, for example a boiler and/or a flow heater, or a general supply with fresh water, for example mains water, water from a treatment system (for example an osmosis system or reverse-osmosis system).

Overall, the cleaning device according to this disclosure and the method according to this disclosure can ensure efficient cleaning of washware, it being possible for said cleaning device and method to involve a considerable saving of resources in comparison to conventional cleaning devices and cleaning methods. Therefore, for example, the consumption of fresh water as a significant constituent part of the total consumption of resources can be considerably reduced. Furthermore, the electrical energy requirement can also be considerably reduced, for example the electrical energy requirement for heating the final-rinse fluid. Since the final-rinse fluid can additionally contain additives, such as the final-rinse aid and/or detergents for example, expenditure on resources of this kind in the form of additives can also be considerably reduced by an overall reduction in the quantity of final-rinse fluid in the cleaning method.

In summary, the following embodiments are preferred within the scope of this disclosure:

Embodiment 1

Cleaning device for cleaning washware, in particular a conveyor dishwasher, comprising at least one cleaning chamber and at least one transportation device, wherein the transportation device is designed to transport the washware through the cleaning chamber in a transportation direction, wherein the cleaning device has at least one final-rinse nozzle system for applying at least one final-rinse fluid, in particular fresh water, to the washware, wherein the final-rinse nozzle system has at least two final-rinse nozzle units which are arranged in different positions transverse to the transportation direction, wherein the final-rinse nozzle units can be switched independently of one another in order to apply the final-rinse fluid to the washware in the different positions independently of one another, in particular independently of one another in application regions which are arranged next to one another.

Embodiment 2

Cleaning device according to the preceding embodiment, wherein the cleaning device is selected from the group comprising a belt-conveyor dishwasher and a rack-conveyor dishwasher.

Embodiment 3

Cleaning device according to either of the preceding embodiments, wherein the transportation device can be populated with several items of washware next to one another transverse to the transportation direction.

Embodiment 4

Cleaning device according to one of the preceding embodiments, wherein the transportation device has at least one conveyor belt and/or at least one conveyor roller.

Embodiment 5

Cleaning device according to one of the preceding embodiments, wherein the transportation device has a transportation width of at least 300 mm, preferably at least 500 mm, in particular at least 750 mm, particularly preferably at least 1000 mm, in particular at least 1200 mm, transverse to the transportation direction.

Embodiment 6

Cleaning device according to one of the preceding embodiments, wherein the final-rinse nozzle system has at least three final-rinse nozzle units, preferably at least four, and particularly preferably at least six final-rinse nozzle units, which are arranged next to one another transverse to the transportation direction.

Embodiment 7

Cleaning device according to one of the preceding embodiments, wherein the final-rinse nozzle units are arranged in at least one nozzle arm which is arranged transverse to the transportation direction.

Embodiment 8

Cleaning device according to one of the preceding embodiments, wherein the final-rinse nozzle system has at least one first group of final-rinse nozzle units and at least one second group of final-rinse nozzle units, wherein the first group is arranged above the washware and is designed to apply the final-rinse fluid to the washware from above, wherein the second group is arranged below the washware and is designed to apply the final-rinse fluid to the washware from below.

Embodiment 9

Cleaning device according to one of the preceding embodiments, wherein an associated switching element is connected upstream of each final-rinse nozzle unit, wherein the associated switching element can be switched in order to switch the application of final-rinse fluid by means of the final-rinse nozzle unit to the washware by means of the associated switching element.

Embodiment 10

Cleaning device according to the preceding embodiment, wherein the switching element is selected from the group comprising: a valve, in particular a solenoid valve and/or a valve having at least one piezo actuator; a slide, in particular a slide which can be mechanically operated; and a tap.

Embodiment 11

Cleaning device according to either of the two preceding embodiments, wherein the switching element is selected from the group comprising: an open/close switching element having precisely one open state, in which the final-rinse fluid is passed, and a closed state, in which the final-rinse fluid is blocked; a switching element having at least one open state, in which the final-rinse fluid is passed, and at least one closed state, in which the final-rinse fluid is passed, and also at least one intermediate state, wherein the final-rinse fluid is passed at a volumetric flow rate and/or mass flow rate which is reduced in comparison to the open state.

Embodiment 12

Cleaning device according to one of the preceding embodiments, wherein final-rinse fluid can be applied to the final-rinse nozzle units in each case by means of at least one final-rinse fluid supply.

Embodiment 13

Cleaning device according to the preceding embodiment, wherein the final-rinse nozzle units are fed by means of a common final-rinse fluid supply, in particular a common fresh-water supply.

Embodiment 14

Cleaning device according to the preceding embodiment, wherein the final-rinse nozzle units are connected to the common final-rinse fluid supply via final-rinse lines, wherein in each case at least one associated switching element is arranged in each final-rinse line.

Embodiment 15

Cleaning device according to one of the preceding embodiments, wherein the cleaning device has at least one treatment device which is designed to adjust at least one property of the final-rinse fluid before said final-rinse fluid is supplied to the final-rinse nozzle system.

Embodiment 16

Cleaning device according to the preceding embodiment, wherein the treatment device is selected from the group comprising: a temperature-control device for adjusting a temperature of the final-rinse fluid, in particular a flow heater and/or a boiler; a treatment system for adjusting a purity of the final-rinse fluid, in particular a filter and/or an osmosis system; a metering device for adjusting at least one concentration of one component of the final-rinse fluid, in particular of a final-rinse aid.

Embodiment 17

Cleaning device according to one of the preceding embodiments, wherein the cleaning device further has at least one control means, wherein the control means is designed to switch the final-rinse nozzle units.

Embodiment 18

Cleaning device according to the preceding embodiment, wherein the control means is designed to combine several final-rinse nozzle units into groups as required, wherein the final-rinse nozzle units in a respective group are switched together.

Embodiment 19

Cleaning device according to one of the preceding embodiments, wherein the cleaning device has at least one washware sensor, wherein the washware sensor is designed to identify the presence and/or a position of the washware, wherein the cleaning device is designed to switch on or to switch off the final-rinse nozzle units in accordance with a requirement which is detected by means of the washware sensor.

Embodiment 20

Cleaning device according to the preceding embodiment, wherein the final-rinse nozzle system has a plurality of application regions which are arranged next to one another transverse to the transportation direction, wherein at least one final-rinse nozzle unit is associated with each application region, wherein final-rinse fluid from the associated final-rinse nozzle unit can be applied to washware within the application region, wherein the cleaning device is designed to switch on the associated final-rinse nozzle unit when the washware sensor identifies that there is washware within the application region, and wherein the cleaning device is further designed to switch off the respective final-rinse nozzle unit when the washware sensor identifies that there is no washware within the application region.

Embodiment 21

Cleaning device according to either of the two preceding embodiments, wherein the washware sensor is selected from the group comprising: an electrical washware sensor, for example a capacitive and/or inductive washware sensor; an electromechanical washware sensor, for example a washware sensor in the form of an electromechanical momentary-contact switch and/or electromechanical switch and/or in the form of an electromechanical lever; a mechanical washware sensor, in particular a mechanical switch and/or a mechanical momentary-contact switch; an inductive washware sensor; an ultrasound washware sensor; an optical washware sensor, in particular a washware sensor which is based on infrared rays and/or which is based on ultraviolet rays and/or which is based on visible light, for example at least one light barrier and/or at least one optical reflection sensor; and an image-recording sensor, for example a camera system.

Embodiment 22

Cleaning device according to one of the three preceding embodiments, wherein the cleaning device has a plurality of washware sensors.

Embodiment 23

Cleaning device according to the preceding embodiment, wherein a washware sensor is associated with a respective final-rinse nozzle unit or a group of final-rinse nozzle units.

Embodiment 24

Cleaning device according to one of the preceding embodiments, wherein the cleaning device comprises a plurality of cleaning zones, wherein the transportation device is designed to move the washware in succession through the cleaning zones, wherein a cleaning fluid can be applied to the washware in each cleaning zone, wherein the cleaning zones comprise at least one final-rinse zone, wherein the final-rinse nozzle system is arranged in the final-rinse zone.

Embodiment 25

Cleaning device according to the preceding embodiment, wherein the cleaning zones comprise at least one cleaning zone which is arranged upstream of the final-rinse zone in the transportation direction, wherein the upstream cleaning zone is selected from the group comprising: a pre-clearing zone and a wash zone.

Embodiment 26

Cleaning device according to the preceding embodiment, wherein the cleaning device has at least one tank for supplying cleaning fluid to a nozzle system of the upstream cleaning zone, wherein the cleaning device is designed to supply final-rinse fluid, in particular fresh water, from the final-rinse nozzle units to the tank after the final-rinse fluid has been applied to the washware.

Embodiment 27

Cleaning device according to the preceding embodiment, wherein a plurality of tanks are provided, wherein at least one of the tanks has an overflow and/or another liquid-transfer device to an upstream tank, wherein the upstream tank feeds a nozzle system which is arranged upstream in the transportation direction.

Embodiment 28

Cleaning device according to one of the four preceding embodiments, wherein at least one drying zone is arranged downstream of the final-rinse zone in the transportation direction.

Embodiment 30

Method for cleaning washware, wherein the washware is transported through at least one cleaning chamber of a cleaning device by means of at least one transportation device, wherein at least one final-rinse fluid is applied to the washware by means of at least one final-rinse nozzle system, wherein the final-rinse nozzle system has at least two final-rinse nozzle units which are arranged in different positions transverse to the transportation direction, wherein the final-rinse nozzle units are switched independently of one another in order to apply the final-rinse fluid to the washware in the different positions independently of one another, in particular independently of one another in application regions which are arranged next to one another.

Embodiment 30

Method according to the preceding embodiment, wherein a cleaning device according to one of the preceding embodiments relating to a cleaning device is used.

Embodiment 31

Method according to either of the two preceding embodiments, wherein at least one washware sensor is used in order to identify the presence of the washware and/or a position of the washware, wherein the final-rinse nozzle units are switched on or switched off in accordance with a requirement which is detected by means of the washware sensor.

Embodiment 32

Method according to the preceding embodiment, wherein the final-rinse nozzle system has a plurality of application regions which are arranged next to one another transverse to the transportation direction, wherein at least one final-rinse nozzle unit is associated with each application region, wherein final-rinse fluid from the associated final-rinse nozzle unit can be applied to washware within the application region, wherein the associated final-rinse nozzle unit is switched on when the washware sensor identifies that there is washware within the application region, and wherein the respective final-rinse nozzle unit is switched off when the washware sensor identifies that there is no washware within the application region.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
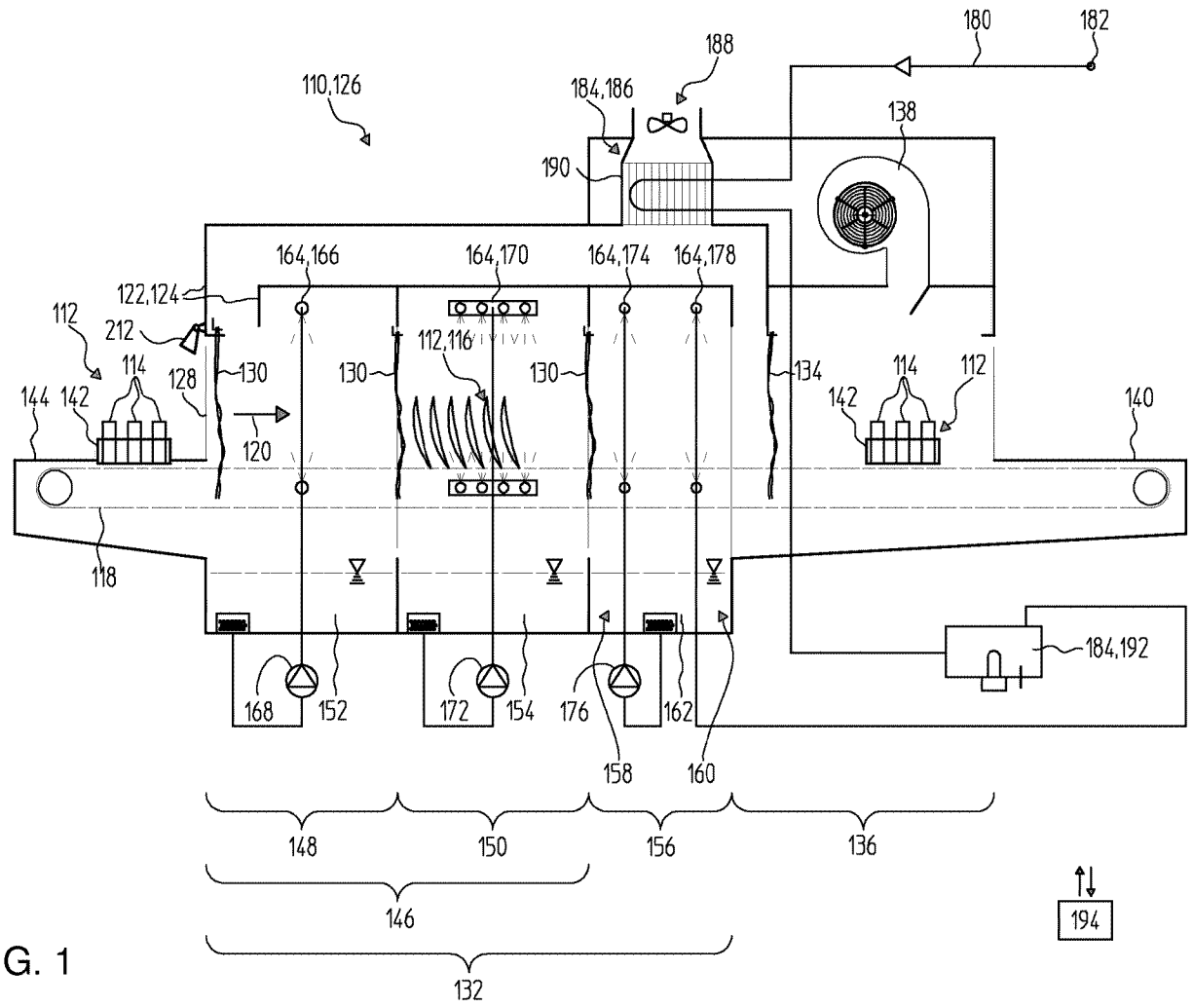
FIG. 1 shows a sectional illustration of an exemplary embodiment of a cleaning device according to this disclosure in a section plane parallel to a transportation direction.

An exemplary embodiment of a cleaning device 110 according to this disclosure for cleaning washware 112 is illustrated in FIG. 1. The washware 112, which is symbolically illustrated in FIG. 1, is shown in the form of, for example, glasses 114 and/or plates 116 by way of example. As an alternative or in addition, further types of washware 112 can be employed or used.

In the illustrated exemplary embodiment, the washware 112 is transported through a cleaning chamber 122 of the cleaning device 110 in a transportation direction 120 by means of a transportation device 118. The cleaning chamber 122 can be designed, for example, as a cleaning tunnel 124 and can have, for example, a housing.

In this and also in other exemplary embodiments, the cleaning device 110 can therefore generally be designed, in particular, as a conveyor dishwasher 126. The washware 112, for example the dishes, is/are transported into the interior of the cleaning chamber 122 at an inlet opening 128 by means of the transportation device 118. The inlet opening 128 can be closed, for example, by a separating curtain 130 which can be opened by the washware 112. In the interior of the cleaning chamber 122, the washware 112 runs through a plurality of cleaning zones 132 which will be explained in greater detail in the text which follows. Said cleaning zones can be separated from one another by separating curtains 130 in turn. Finally, the washware 112 leaves the cleaning chamber 122, for example again through a separating curtain 134, and enters, for example, a drying zone 136. The washware 112 is dried in said drying zone, for example by means of a fan 138, before the washware 112 is transported by the transportation device 118 to an outlet 140 in which said washware can be removed from the cleaning device 110.

The transportation device 118 can be or comprise, for example, a belt-conveyor device and/or a rack-conveyor device. By way of example, at least one conveyor belt and/or one roller conveyor system can be included. The washware 112 can be placed, for example, directly on the transportation device 120, as is shown by way of example in FIG. 1 using the example of the plates 116, and therefore the conveyor dishwasher 126 can be designed, for example, as a belt-conveyor dishwasher. As an alternative or in addition, the washware 112 can also be placed on the transportation device 118, for example, by means of one or more conveyor racks 142, as shown by way of example in the illustrated exemplary embodiment using the example of glasses 114. Accordingly, the cleaning device 110 can be designed, for example, as a rack-conveyor dishwasher. In either case, an inlet 144 can be provided for example, it being possible for the washware 112 to be placed directly or indirectly, for example by means of the conveyor racks 142, on the transportation device 118 at said inlet.

The cleaning device 110 is illustrated in a sectional illustration in a section plane parallel to the transportation direction 120 in FIG. 1. The arrangement of several cleaning zones 132 is shown by way of example in said figure. By way of example, these cleaning zones comprise, for example, a wash zone 146, which for its part can in turn have a pre-wash zone 148 and a main-wash zone 150 for example. The pre-wash zone 148 can also be called a pre-clearing zone for example. The wash zone 146 can comprise, for example, two tanks, a pre-wash zone tank 152 and a main-wash zone tank 154. In this context, the pre-wash zone tank 152 is preferably arranged upstream of the main-wash zone tank 154 in the transportation direction 120.

The cleaning zones 132 further comprise a final-rinse zone 156 which is arranged downstream of the wash zone 146. This final-rinse zone 156 can, for example, for its part in turn comprise a pump final-rinse zone 158 and a fresh-water final-rinse zone 160 which is arranged downstream of this pump final-rinse zone 158 in the transportation direction 120. The final-rinse zone 156 further comprises a final-rinse tank 162 which can also be called a final-rinse zone tank or a pump final-rinse zone tank. Therefore, in the illustrated exemplary embodiment, the following cleaning zones 132 are provided in the transportation direction 120 by way of example: a pre-wash zone 148, a main-wash zone 150, a pump final-rinse zone 158 and a fresh-water final-rinse zone 160. A different manner of arrangement of cleaning zones 132 is also feasible in principle. The following tanks are further provided by way of example: a pre-wash zone tank 152, a main-wash zone tank 154 and a final-rinse tank 162. Another arrangement of tanks is also possible in principle. By way of example, the purity of a cleaning fluid in the tanks 152, 154 and 162 can increase in the transportation direction 120. This can be implemented, for example, by an overflow from the final-rinse tank 162 to the main-wash zone tank 154 being provided and/or an overflow from the main-wash zone tank 154 to the pre-wash zone tank 152 being provided.

In the illustrated exemplary embodiment, the cleaning device 110 further has a plurality of cleaning systems 164 which can be designed as nozzle systems in each case. These cleaning systems 164 or nozzle systems can comprise, for example, a pre-clearing zone nozzle system 166 which can also be designed as a pre-clearing zone spray-nozzle system and which can comprise, for example, at least one spray arm in each case above and below the washware 112. The pre-clearing zone nozzle system 166 can be fed with cleaning fluid from the pre-wash zone tank 152, for example, by means of a pre-wash zone pump 168.

The cleaning system 164 can further have at least one main-wash zone nozzle system 170 which can be designed, for example, as a main-wash zone spray-nozzle system and which in turn can have, for example, as shown in FIG. 1, at least one spray arm above the washware 112 and at least one spray arm below the washware 112. The main-wash zone nozzle system 170 can be fed, for example, with cleaning fluid from the main-wash zone tank 154 by means of a main-wash zone pump 172.

Several cleaning systems 164 can also be provided within the final-rinse zone 156. Therefore, a pump final-rinse zone nozzle system 174 is provided in the illustrated exemplary embodiment, it being possible for said pump final-rinse zone nozzle system to have, for example, in turn a spray arm above the washware 112 and a spray arm below the washware 112. This pump final-rinse zone nozzle system 174, which can in turn be designed, for example, as a pump final-rinse zone spray-nozzle system 174, can be fed with cleaning fluid in the form of final-rinse fluid from the final-rinse tank 162, for example, by means of at least one pump final-rinse zone pump 176. Furthermore, a cleaning system 164 in the form of a fresh-water final-rinse zone nozzle system 178, which in turn can be designed as a fresh-water final-rinse zone spray-nozzle system for example, is arranged downstream of the pump final-rinse zone nozzle system 174 in the transportation direction 120. Said cleaning system can be fed with fresh water, for example, by means of a fresh-water inlet 180 from a fresh-water connection 182. One or more treatment devices 184 for adjusting at least one property of the fresh water can be provided in this case. Two temperature-control devices are provided by way of example in the illustrated exemplary embodiment in order to heat the fresh water. By way of example, a first treatment device 184 in the form of a heat-recovery device 186 can be provided, for example with an intake fan 188 for drawing hot air from the cleaning chamber 122 and a heat exchanger 190 for transferring the recovered heat from the waste air to the fresh water.

Furthermore, a treatment device 184 in the form of a flow heater 192 and/or a fresh-water boiler can be provided, for example in order to finally heat the fresh water to an operating temperature, for example a temperature of from 80° C.-100° C., for example a temperature of from 85° C.-95° C. Another refinement is also possible.

The cleaning device 110 can further comprise a control means 194, for example a control means with a data-processing device. The control means 194 can be designed, for example, to control a program sequence of the cleaning device 110, for example by various sensors being interrogated and/or pumps 168, 172, 176 being driven and/or by the transportation device 118 being driven. Various refinements are possible and are known in principle to a person skilled in the art.

The refinement of the cleaning device 110 according to this disclosure relates, in particular, to the design of the final-rinse zone 156 and, in particular, the cleaning system 164 which is arranged in said final-rinse zone. The refinement according to this disclosure will be described in the text which follows, in particular with reference to the fresh-water final-rinse zone nozzle system 178 by means of which cleaning fluid in the form of fresh water can be applied to the washware 112, possibly with the addition of one or more auxiliaries or additives, for example with the addition of final-rinse aid. It should also be noted however that this disclosure could also be implemented in all other dishwashing systems in the dishwasher in principle.

Figure 2:
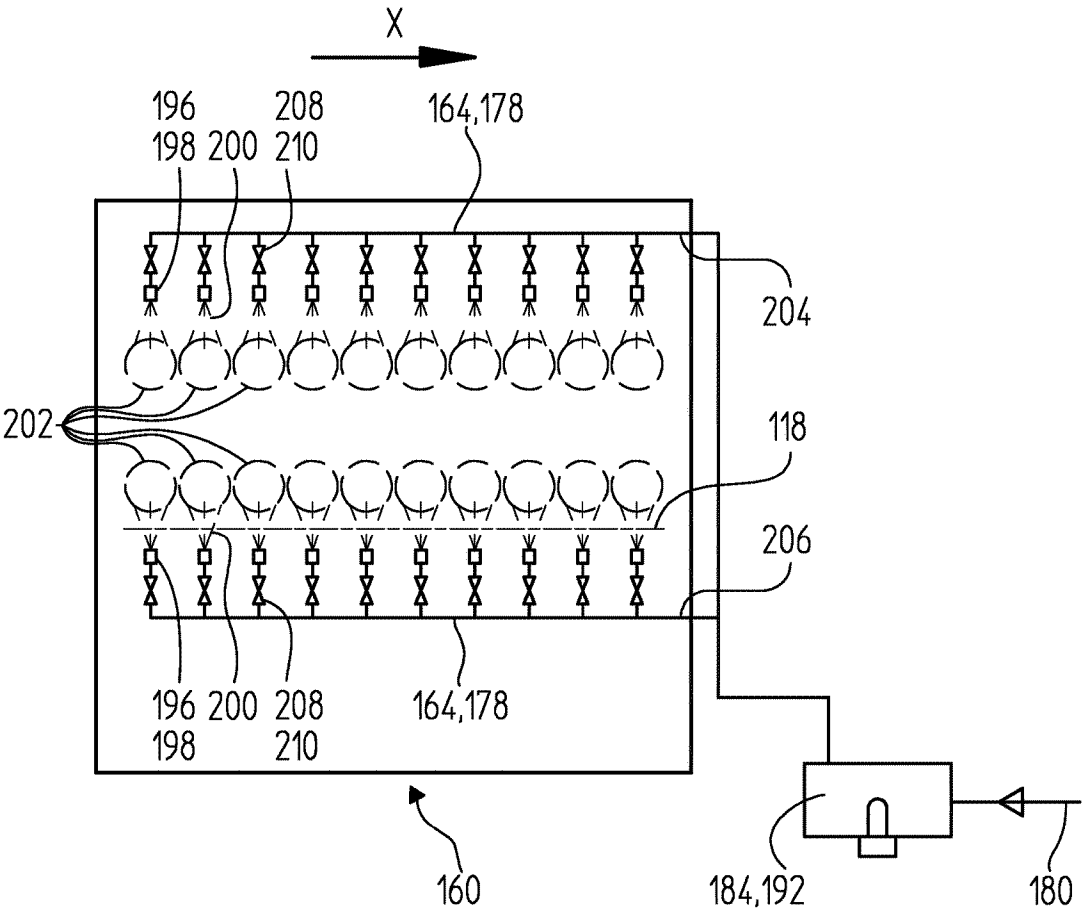
FIG. 2 shows a sectional illustration of the exemplary embodiment according to FIG. 1 in a section plane perpendicular to the transportation direction.
Figure 3:
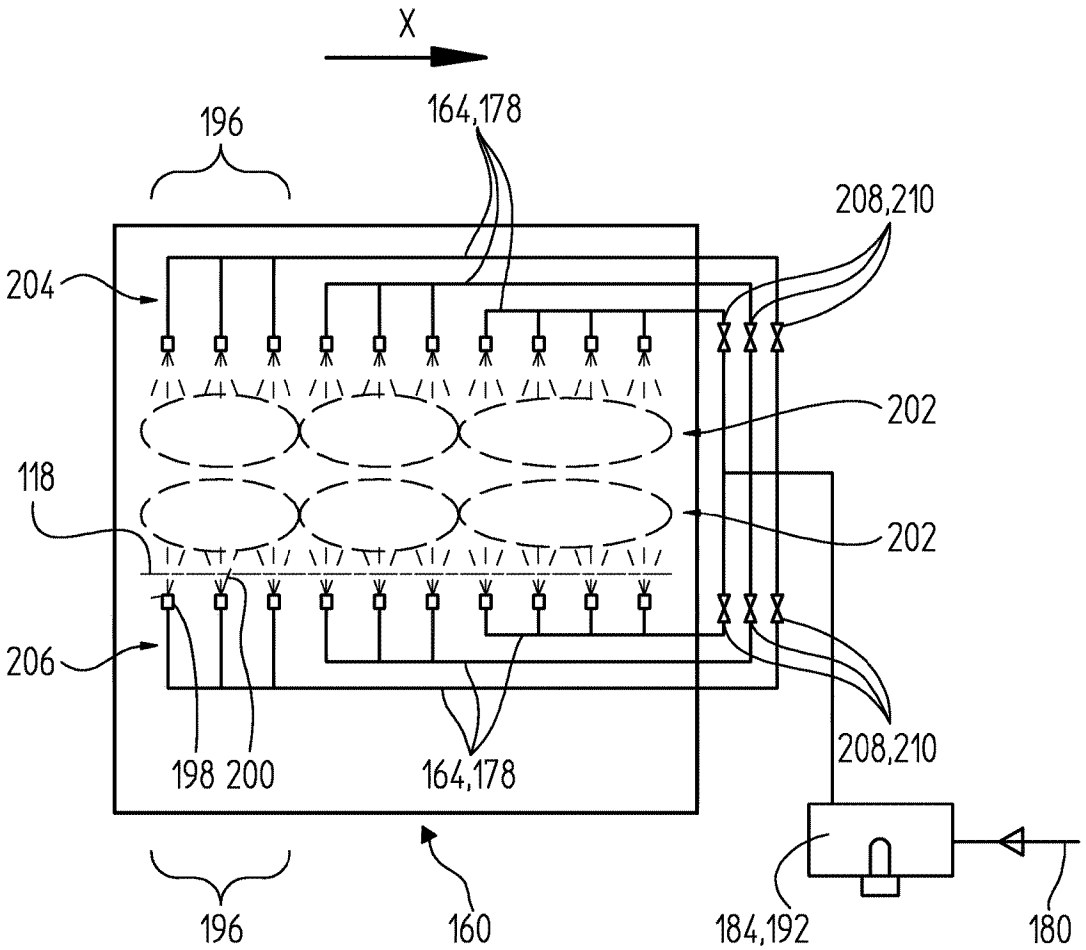
FIG. 3 shows an exemplary embodiment, which is an alternative to FIG. 2, of a cleaning device in a sectional illustration in a section plane perpendicular to the transportation direction.

Two different refinements of the fresh-water final-rinse zone 160 are shown in a sectional illustration perpendicular to the transportation direction 120 through the fresh-water final-rinse zone 160 in FIGS. 2 and 3. Therefore, it can be seen in each exemplary embodiment that the fresh-water final-rinse zone nozzle system comprises a plurality of final-rinse nozzle units 196. Each of said final-rinse nozzle units can comprise one or more final-rinse nozzles 198 which can dispense, for example, in each case one or more spray jets 200 onto the washware 112 (not illustrated in FIGS. 2 and 3) on the transportation device 118. In this context, the final-rinse nozzle units 196 are arranged in different positions along a direction transverse to the transportation direction 120, for example perpendicular to the transportation direction 120, in both exemplary embodiments. A direction in space perpendicular to the transportation direction 120 and parallel to a surface of the transportation device 118 is denoted x in FIGS. 2 and 3 by way of example. As can be seen in FIGS. 2 and 3, the final-rinse nozzle units 196 are arranged offset in relation to one another in this direction x transverse to the transportation direction 120. This produces, for the washware on the transportation device 118, a plurality of application regions 202 which are situated next to one another, that is to say offset transverse to the transportation direction in the direction x in space, and which are symbolically indicated in FIGS. 2 and 3 and to each of which final-rinse fluid can be applied by one or more final-rinse nozzle units 196 which are associated with these application regions 202. By way of example, for each application region 202, an associated final-rinse nozzle unit 196 can be provided above this application region 202, and an associated final-rinse nozzle unit 196 can be provided below the respective application region 202. This can be implemented, for example, by an upper spray arm 204 and a lower spray arm 206. Other refinements are also possible.

In the two exemplary embodiments in FIGS. 2 and 3, provision is made according to this disclosure in this context for the final-rinse nozzle units 196 to each be able to be switched, for example between a switched-on state and a switched-off state, independently of the other final-rinse nozzle units 196. To this end, the fresh-water final-rinse zone nozzle system 178 can have, for example, a plurality of switching elements 208 which can be designed, for example, as valves 210. The final-rinse nozzle units 196 can be switched independently of one another by means of these switching elements 208, in particular the valves 210, so that final-rinse fluid can be applied, or not, to the application regions 202 independently of one another by corresponding switching of the switching elements 208, for example in a manner controlled by the control means 194.

In this context, the exemplary embodiments in FIGS. 2 and 3 differ in that, in the exemplary embodiment according to FIG. 2, each final-rinse nozzle unit 196 comprises precisely one final-rinse nozzle 198 which can be switched by a corresponding switching element 208. However, in the exemplary embodiment according to FIG. 3, several final-rinse nozzles 198 are each combined to form groups which each form a switchable final-rinse nozzle unit 196 which can be switched in each case by means of a switching element 208, for example a valve 210. Accordingly, in the exemplary embodiment according to FIG. 3, each final-rinse nozzle unit 196 comprises a plurality of final-rinse nozzles 198 which are arranged next to one another in direction x.

The special feature of the refinement according to this disclosure of the ability to independently switch the final-rinse nozzle units 196 which are arranged next to one another is that the application can be matched to occupation of the transportation device 118 by washware 112. For example, switching of the final-rinse nozzle units 196 in accordance with requirements can be performed depending on occupation of the transportation device 118 at the site of the fresh-water final-rinse zone nozzle system 178. In order to identify occupation, one or more washware sensors 212 can be provided for example, as illustrated in FIG. 1. In the illustrated exemplary embodiment, the washware sensor 212 is provided at the inlet opening 128. As an alternative or in addition however, this at least one washware sensor 212 can also be arranged in other areas within or outside the cleaning device 110, for example within the cleaning chamber 122. By way of example, the washware sensor 212 can comprise an optical sensor, for example a camera system. In this way, occupation of the transportation device 118, for example occupation of a belt, can be detected for example. Since the transportation speed of the transportation device 118 is known in principle, for example by corresponding driving and/or on account of corresponding signals in the control means 194, and the distance of the washware sensor 212 from the fresh-water final-rinse zone nozzle system 178 is also known, it is accordingly possible to know, at any time, how the belt is occupied in the application regions 202 in the region of the fresh-water final-rinse zone nozzle system 178, even if the washware sensor 212 is arranged at a distance from the fresh-water final-rinse zone 160 in the transportation direction 120. Accordingly, the control means 194 can be designed to switch on only those final-rinse nozzle units 196 which supply final-rinse fluid to an application region 202 in which there is actually washware 112. The other final-rinse nozzle units 196 can be switched off or remain switched off by corresponding switching of the switching elements 208, so that final-rinse fluid is not unnecessarily sprinkled in said application regions 202. In this way, it is possible to save considerable quantities of final-rinse fluid, in particular fresh water, independently of the respectively selected refinement, for example according to FIG. 2 or according to FIG. 3, by switching off the final-rinse nozzle units 196 as required.

LIST OF REFERENCE SYMBOLS

| | | | |
|---|---|---|---|
| 110 | Cleaning device | 162 | Final-rinse tank |
| 112 | Washware | 164 | Cleaning system, nozzle system |
| 114 | Glasses | 166 | Pre-clearing zone nozzle system |
| 116 | Plates | 168 | Pre-wash zone pump |
| 118 | Transportation device | 170 | Main-wash zone nozzle system |
| 120 | Transportation direction | 172 | Main-wash zone pump |
| 122 | Cleaning chamber | 174 | Pump final-rinse zone nozzle system |
| 124 | Cleaning tunnel | 176 | Pump final-rinse zone pump |
| 126 | Conveyor dishwasher | 178 | Fresh-water final-rinse zone nozzle system |
| 128 | Inlet opening | 180 | Fresh-water inlet |
| 130 | Separating curtain | 182 | Fresh-water connection |
| 132 | Cleaning zones | 184 | Treatment device |
| 134 | Separating curtain | 186 | Heat-recovery device |
| 136 | Drying zone | 188 | Intake fan |
| 138 | Fan | 190 | Heat exchanger |
| 140 | Outlet | 192 | Flow heater |
| 142 | Conveyor rack | 194 | Control means |
| 144 | Inlet | 196 | Final-rinse nozzle unit |
| 146 | Wash zone | 198 | Final-rinse nozzles |
| 148 | Pre-wash zone | 200 | Spray jet |
| 150 | Main-wash zone | 202 | Application region |
| 152 | Pre-wash zone tank | 204 | Upper spray arm |

-continued

| LIST OF REFERENCE SYMBOLS | | | |
|---|---|---|---|
| 154 | Main-wash zone tank | 206 | Lower spray arm |
| 156 | Final-rinse zone | 208 | Switching element |
| 158 | Pump final-rinse zone | 210 | Valve |
| 160 | Fresh-water final-rinse zone | 212 | Washware sensor |

What is claimed is:

1. A cleaning device for cleaning washware, comprising:

a cleaning chamber;

a transportation device configured to transport the washware through the cleaning chamber in a transportation direction; and a final-rinse nozzle system configured for applying a final-rinse fluid to the washware, the final-rinse nozzle system having at least two final-rinse nozzle units arranged in different positions transverse to the transportation direction and arranged next to one another as seen in the direction of the transportation direction;

each final-rinse nozzle unit having an associated switching element, each switching element being switchable to turn on or off the application of final-rinse fluid to the washware from the respective final-rinse nozzle unit, wherein the switching elements are switchable independently of one another to thereby apply the final-rinse fluid to the washware in the different positions independently of one another.

2. The cleaning device as claimed in claim 1, wherein the cleaning device is a conveyer dishwasher.

3. The cleaning device as claimed in claim 1, wherein the final-rinse fluid is fresh water.

4. The cleaning device as claimed claim 1, wherein the final-rinse nozzle system has at least three final-rinse nozzle units arranged next to one another transverse to the transportation direction.

5. The cleaning device as claimed in claim 4, wherein the final-rinse nozzle system has at least four final-rinse nozzle units.

6. The cleaning device as claimed in claim 4, wherein the final-rinse nozzle system has at least six final-rinse nozzle units.

7. The cleaning device as claimed in claim 1, wherein each final-rinse nozzle unit has an associated switching element connect upstream, each switching element being switchable to turn on or off the application of final-rinse fluid to the washware from the respective final-rinse nozzle unit.

8. The cleaning device as claimed in claim 1, wherein the switching element is a valve.

9. The cleaning device as claimed in claim 8, wherein the switching element is selected from the group consisting of a magnetic valve, a solenoid valve and a valve having at least one piezo actuator.

10. The cleaning device as claimed in claim 1, wherein the switching element is a slide which can be mechanically operated.

11. The cleaning device as claimed in claim 1, wherein the cleaning device has at least one treatment device which is configured to adjust at least one property of the final-rinse fluid before said final-rinse fluid is supplied to the final-rinse nozzle system.

12. The cleaning device as claimed in claim 11, wherein the treatment device is a temperature-control device for adjusting a temperature of the final-rinse fluid.

13. The cleaning device as claimed in claim 12, wherein the temperature-control device is a flow heater and/or a boiler.

14. The cleaning device as claimed in claim 1, further comprising at least one controller configured to control the switching elements.

15. The cleaning device as claimed in claim 14, wherein the at least two final-rinse nozzle units comprise at least four final rinse nozzle units and the controller is configured to control at least two of the switching elements together, as a group.

16. The cleaning device as claimed in claim 1, wherein the cleaning device has at least one washware sensor configured to identify the presence of the washware and/or a position of the washware, wherein the cleaning device is configured to control the final-rinse nozzle units in accordance with a requirement which is detected by the washware sensor.

17. The cleaning device as claimed in claim 16, wherein the final-rinse nozzle system has a plurality of application regions arranged next to one another transverse to the transportation direction, wherein at least one final-rinse nozzle unit is associated with each application region, wherein final-rinse fluid from the associated final-rinse nozzle unit can be applied to washware within the application region, wherein the cleaning device is configured to switch on the associated final-rinse nozzle unit when the washware sensor identifies that there is washware within the application region, and wherein the cleaning device is further configured to switch off the respective final-rinse nozzle unit when the washware sensor identifies that there is no washware within the application region.

18. The cleaning device as claimed in claim 16, wherein the washware sensor is selected from the group comprising: an electrical washware sensor; a capacitive washware sensor; an inductive washware sensor; an electromechanical washware sensor; and an inductive washware sensor.

19. The cleaning device as claimed in claim 16, wherein each final-rinse nozzle unit or group of final-rinse nozzle units has an associated washware sensor.

20. The cleaning device as claimed in claim 11, wherein the treatment device is a treatment system for adjusting a purity of the final-rinse fluid.

21. The cleaning device as claimed in claim 11, wherein the treatment device is a metering device for adjusting at least one concentration of a component of the final-rinse fluid.

22. The cleaning device as claimed in claim 20, wherein the treatment system is a filter and/or an osmosis system.

23. The cleaning device as claimed in claim 21, wherein the component of the final-rinse fluid is a final rinse aid.

24. The cleaning device as claimed in claim 1, wherein the switching element is a tap.

25. The cleaning device as claimed in claim 16, wherein the washware sensor is a mechanical washware sensor.

26. The cleaning device as claimed in claim 16, wherein the washware sensor is an ultrasound washware sensor.

27. The cleaning device as claimed in claim 16, wherein the washware sensor is an optical washware sensor or an image-recording sensor.

* * * * *